US006402940B1

(12) United States Patent
Rappas

(10) Patent No.: US 6,402,940 B1
(45) Date of Patent: Jun. 11, 2002

(54) PROCESS FOR REMOVING LOW AMOUNTS OF ORGANIC SULFUR FROM HYDROCARBON FUELS

(75) Inventor: Alkis S. Rappas, Kingwood, TX (US)

(73) Assignee: Unipure Corporation, Houston, TX (US)

( * ) Notice: Subject to any disclaimer, the term of this patent is extended or adjusted under 35 U.S.C. 154(b) by 0 days.

(21) Appl. No.: 09/654,016

(22) Filed: Sep. 1, 2000

(51) Int. Cl.[7] ..... C10G 29/22

(52) U.S. Cl. ..... 208/240; 208/237; 208/238; 208/219; 208/222; 208/223; 208/196

(58) Field of Search ..... 208/237, 238, 208/240, 219, 223, 222, 196

(56) References Cited

U.S. PATENT DOCUMENTS

| | | | | |
|---|---|---|---|---|
| 3,761,534 A | * | 9/1973 | Sun et al. | 260/674 A |
| 3,816,301 A | * | 6/1974 | Sorgenti | 208/208 R |
| 5,310,479 A | | 5/1994 | Audeh | 208/219 |
| 5,573,672 A | * | 11/1996 | Rappus et al. | 210/638 |
| 5,753,102 A | * | 5/1998 | Funakoshi et al. | 208/208 R |
| 5,958,224 A | | 9/1999 | Ho et al. | 208/240 |
| 5,985,137 A | * | 11/1999 | Ohsol et al. | 208/263 |
| 6,160,193 A | | 12/2000 | Gore | 585/833 |
| 6,171,478 B1 | | 1/2001 | Cabrera et al. | 208/212 |

FOREIGN PATENT DOCUMENTS

| | | | |
|---|---|---|---|
| EP | 0565324 A1 | 5/1993 | C10G/53/14 |

OTHER PUBLICATIONS

PCT International Search Report—do not print–no date.

"Oxidative desulphurisation of oils via hydrogen peroxide and heteropolyanion catalysis" by Frances M. Collins, Andrew, R. Lucy, Christopher Sharp—No Month.

"Desulfurization By Selective Oxidation And Extraction Of Sulfur–Containing Compounds To Economically Achieve Ultra–Low Proposed Diesel Fuel Sulfur Requirements" by Doug Chapados, et al.—No Month.

* cited by examiner

*Primary Examiner*—Nadine Preisch
(74) *Attorney, Agent, or Firm*—Jenkens & Gilchrist

(57) ABSTRACT

A process for desulfurizing fuels such as diesel oil and similar petroleum products to reduce the sulfur content to a range of from about 2 to 15 ppm sulfur is described. The sulfur containing fuel is contacted at slightly elevated temperatures with an oxidizing/extracting solution of formic acid, a small amount of hydrogen peroxide, and no more than about 25 wt % water. A removal process for separating substituted dibenzothiophene oxidation products from tile fuel is also described.

18 Claims, 7 Drawing Sheets

Residual Thiophenic Sulfur in Oil Phase vs. Formic Acid Concentration in Aqueous Oxidizer-Extractor Residual Thiophenic Sulfur in Oil Phase vs. $H_2O_2$ Stoichiometry Factor Range and Sensitivity of Thiophenic Sulfur Oxidation to Acid/Hydrogen Peroxide Ratio, Kerosene/DBT System

PROCESS FOR REMOVING LOW AMOUNTS OF ORGANIC SULFUR FROM HYDROCARBON FUELS

BACKGROUND OF THE INVENTION

This invention relates to a process for the removal of organic sulfur compounds by oxidation from hydrocarbon fuels which have relatively low amounts of sulfur present, such as in fuels which have been through a hydrogenation step to remove organic sulfur compounds.

The presence of sulfur in hydrocarbons has long been a significant problem from the exploration, production, transportation, and refining all the way to the consumption of hydrocarbons as a fuel, especially to power automobiles and trucks. Now, it has become an environmental objective to rid fuels such as diesel fuel, gasoline, fuel oils, jet fuel, kerosine, and the like of the troublesome residual organic sulfur present in such hydrocarbons, even though on a relative basis the amount present to begin with is small such as, for example, in diesel fuel the sulfur content may be about 500 parts per million by weight, or less. However, under the present regime even this amount has become too much with extant and prospective regulation of sulfur emissions from many sources becoming increasingly strict.

The prior art is replete with attempts to reduce the sulfur content of hydrocarbon by both reduction and oxidation of organic sulfur present. Much of this prior art relating to oxidation has taught the use of various peroxides in conjunction with a carboxylic acid and, specifically, the preferred species involved in the practice of this invention; i.e., hydrogen peroxide and formic acid. For example, U.S. Pat. No. 5,310,479 teaches the use of formic acid and hydrogen peroxide to oxidize sulfur compounds in crude oil, limiting the application of the technology only to aliphatic sulfur compounds. There was no hint of the removal of aromatic sulfur compounds. This patent discussion is directed to the removal of sulfur from crude oil rich (about 1–4%) in sulfur compounds. The acid to peroxide ratio was indiscriminately broad and failed to recognize the economic disadvantages to using hydrogen peroxide in attempts to remove large amounts of sulfur, while at the same time failing to recognize the importance of controlling the presence of water to the successful operation. Water was used to extract the sulfones from the treated hydrocarbon in a separate wash step. Further, the prior art also fails to recognize the beneficial effect of limiting the peroxide concentration to low values without compromising either the rate or extent of oxidation of the sulfur compounds.

A recent study entitled "Oxidated Desulfurization of Oils by Hydrogen Peroxide and Heteropolyanion Catalyst," Collins, et al., published *Journal of Molecular Catalysis A: Chemical*, 117 (1997) 397–403, discusses other studies to oxidatively remove sulfur from fuel oil, but large quantities of hydrogen peroxide were required. However, the experimental work did show that unacceptable amounts of hydrogen peroxide were consumed thus suggesting the cost of oxidative reduction of sulfur in feedstocks for diesel fuel to be impermissibly high.

In European Patent Application Publication No. 0565324A1, a method for recovering organic sulfur compounds from liquid oil is described. While the stated objective of the patent publication is to recover the organic sulfur compound, the treatment involves using a mixture of a number of oxidants, one of which is disclosed as a mixture of formic acid and peroxide. The distillation products, the organic sulfones, are removed by a number of methods including absorption on alumina or silica adsorbent materials. The treatments described are characterized by use of a low ratio of formic acid to the hydrogen peroxide.

While this and other prior art recognize the reaction kinetics and mechanism of hydrogen peroxide and other peroxides with organic sulfur compounds present in various fuels, none recognize the combination of factors necessary to successfully and economically remove relatively small amounts of sulfur present in fuels such as diesel oil, kerosine, gasoline, and light oils down to residual levels approaching zero. While low amounts of sulfur will be construed to mean in the context of this invention, those amounts which are less than about 1500 parts per million, an eaxample demonstrates effective removal of 7000 ppm of sulfur such that the present invention is applicable to higher levels of sulfur. Of course in some instances, the practice of this invention may be economically and technically applicable to the treatment of fuels having a sulfur content at these elevated levels. It has been found in the practice of this invention that the sulfur content of the fuel which is left unoxidized is less than about 10 ppm of sulfur, often as low as between 2 ppm and 8 ppm. Oxidation alone does not necessarily ensure total removal of the sulfur to the same low residual sulfur values since some of the oxidized sulfur species do have a non-zero solubility in the fuel, and a partition coefficient that defines their distribution in the oil phase in contact with a substantially immiscible solvent phase, whether it is an organic solvent as in prior art, or the high acid aqueous phase of this invention. In addition to the substantially complete and rapid oxidation of the relatively low amounts of sulfur in the fuel feed, the present invention also teaches the substantially complete removal of the oxidized sulfur to residual levels approaching zero, and the recovery of the oxidized sulfur compounds in a form suitable for their practical further disposition in an environmentally benign way.

The sulfur compounds which are most difficult to remove by hydrogenation appear to be the thiophene compounds, especially benzothiopene, dibenzothiopene, and other homologs. In an article, Desulfurization by Selective Oxidation and Extraction of Sulfur-Containing Compounds to Economically Achieve Ultra-Low Proposed Diesel Fuel Sulfur Requirements (Chapados, et al., NPRA Presentation, Mar. 26–28, 2000) the oxidation step involved the reaction of the sulfur in a model compound using dibenzothiophene with a peroxyacetic acid catalyst made from acetic acid and hydrogen peroxide. The reaction with the peroxyacid was conducted at less than 100° C. at atmospheric pressure and in less than 25 minutes. After extraction, the process resulted in a reduction of the sulfur content in the diesel fuel. Still, the cost was indicated to be high with the hydrogen peroxide being the biggest cost item and consumed in the process due in large part to the lack of recognition of the part excessive water plays in the efficient utilization of low amounts of hydrogen peroxide.

SUMMARY OF THE INVENTION

It has been discovered that fuel oils such as diesel fuel, kerosene, and jet fuel, though meeting the present requirements of about 500 ppm maximum sulfur content, can be economically treated to reduce the sulfur content to an amount of from about 5 to about 15 ppm, in some instances even less. In practicing the process of the present invention the hydrocarbon fuel containing low amounts of organic sulfur compounds, i.e., up to about 1500 ppm, is treated by contacting the sulfur-containing fuel with an oxidizing solution containing hydrogen peroxide, formic acid, and a limit of a maximum of about 25 percent water. The amount of the hydrogen peroxide in the oxidizing solution is greater than about two times the stochiometric amount of peroxide necessary to react with the sulfur in the fuel. The oxidizing solution used contains hydrogen peroxide at low concentration, the concentration, in its broadest sense, being from about 0.5 wt % to about 4 wt %. The reaction is carried out at a temperature of from about 50° C. to about 130° C. for less than about 15 minutes contact time at close to, or slightly higher than atmospheric pressure at optimum conditions. The oxidizing solution of the invention has, not only a low amount of water, but small amounts of hydrogen peroxide with the acid, with the formic acid being the largest constituent. The oxidation products, usually the corresponding organic sulfones, become soluble in the oxidizing solution and, therefore, may be removed from the desulfurized fuel by an almost simple simultaneous extraction and a subsequent phase separation step. The aqueous phase is removed from the hydrocarbon phase which now has a reduced sulfur content. While all sulfur-containing constituents of the fuel may not be removed to the desired very low residual sulfur levels by the extraction step into the now spent oxidizer solution, the conversion and concentration reduction of sulfur in such fuels in the oxidation step provide a more easily accomplished extraction and removal to almost completely desulfurize the resulting liquid hydrocarbons; such as fuel oils, diesel fuel, jet fuel, gasoline, coal liquids, and the like to levels of about 5 to 15 ppm sulfur, and often approaching zero. Where there is a residual amount of oxidized sulfur compounds, usually sulfones, in the fuel, this invention enables the practical and economic use of additional separation steps to remove the residual sulfur by selected solid adsorbants such as, for example, in a cyclic adsorption-desorption operation to achieve a sulfur-free fuel product, and recover the oxidized sulfur compounds in a concentrated form and in a way practical for their final environmentally benign, disposition within a refinery.

Once the extract containing the oxidized sulfur compounds is separated from the desulfurized fuel, or raffinate, the extract can be treated to recover the acid for recycle. The separation is accomplished in a number of ways, but the preferred separation occurs by the use of a liquid-liquid separator operated at a temperature sufficiently high, close to the oxidation reaction temperature, to result in gravity separation of the material without appearance of a third, precipitated solid phase. The aqueous phase, of course, being heavier than the oil phase would be drained from the bottom of the separation device where it may be preferably mixed with a suitable high boiling range refinery stream, such as for example, a gasoil, and flash distilled to remove the water and acid overhead while transferring and leaving the sulfur-containing compounds into the gasoil stream exiting at the bottom of the distillation column. The overhead stream containing acid and water from the flash distillation and sulfone transfer column is further distilled in a separate column to remove portion of its water for disposal. The acid recovered can then be returned to the oxidizing solution make up tank where it is combined with the hydrogen peroxide to form the oxidizing solution and again contact the sulfur-containing fuel feed. This preservation of the acid enhances the economics of the process of this invention.

After separation the fuel maybe further heated and flashed to remove any residual acid/water azeotrope, which can be recycled to the liquid-liquid separation step, or elsewhere in the process. Then the fuel may be contacted with a caustic solution, or with anhydrous calcium oxide (i.e., quicklime) and/or passed through filtering devices to neutralize any trace acid remaining and to make a final dehydration of the fuel. The fuel stream may be then passed over a solid alumina bed, at ambient temperature, to adsorb the residual oxidized sulfur compounds soluble in fuel, if any are present. The product is now thoroughly desulfurized, neutralized, and dry.

The oxidized sulfur compounds adsorbed on alumina may be removed by desorption and solubilization into a suitable hot polar solvent, methanol being the preferred solvent. Other suitable solvents are acetone, THF (tetrahydrofuran), acetonitrile, chlorinated solvents such as methylene chloride as well as the aqueous oxidizer solution with high acid contents of this invention. One advantage of the adsorption/desorption system of this invention is that it can use commercially-available alumina adsorbants that are used in multiple cycles without significant loss of activity and without the need to reactivate them by conventionally employed high temperature treatment for dehydration. The extracted oxidized sulfur compounds are transferred into higher boiling refinery streams for further disposition by flash distillation, which also recovers the methanol for recycle in the alumina desorption operation.

The oxidizing solution of the invention is preferably formed by mixing a commercially-available 96%, by weight, formic acid solution with a commercially-available hydrogen peroxide solution, normally the 30%, 35% and 50 wt % concentration commercially available in order to avoid the dangers connected with handling a 70% hydrogen peroxide solution in a refinery environment. The solutions are mixed to result in an oxidizing material containing from about 0.5 to about 4 wt % hydrogen peroxide, less than 25 wt % water with the balance being formic acid. The water in the oxidizer/extractor solution normally comes from two sources, the dilution water in the peroxide and acid solutions used, and the water in the recycled formic acid, when the process operates in the recycle mode. On occasion, additional water could be added without being detrimental to the practice of this invention as long as the criteria explained herein are considered, but it is important to an economical process to keep the water content low as set forth herein. The preferable concentration of hydrogen peroxide, which is consumed in the reaction, in the oxidizer solution would be from about 1% to about 3% by weight, and most preferably from 2 to 3 wt %. The water content would be limited to less than about 25 wt %, but preferably between about 8 and about 20%, and most preferably from about 8 to about 14 wt %. The oxidation/extraction solution used in the practice of this invention will contain from about 75 wt % to about 92 wt % of carboxylic acid, preferably formic acid, and preferably 79 wt % to about 89 wt % formic acid. The molar ratio of acid, preferably formic acid, to hydrogen peroxide useful in the practice of this invention is at least about 11 to 1 and from about 12 to 1 to about 70 to 1 in the broad sense, preferably from about 20 to 1 to about 60 to 1.

This will accomplish a rapid and complete oxidation of the sulfur compounds, and their substantial extraction from such refined products as diesel fuel, jet fuel, or gasoline which contain from about 200 to about 1500 ppm sulfur and will perform effectively to oxidize and extract organic sulfur present in fuels at greater concentrations. Since the moles of hydrogen peroxide to be used is proportional to the amount of sulfur present and since the peroxide is consumed, the cost of this material can have a negative effect on the economics of the operation if the amount of sulfur present is excessive or if there are other hydrocarbons present in the material being treated which will be oxidized, such as, for example, in crude oil. Of course hydrogen peroxide has a natural tendency to decompose to water and non-reaction oxygen under these conditions. Therefore, this invention is properly most useful for polishing small amounts of sulfur, such as for example less than about 1000 ppm, from hydrocarbon fuels ready for market than for removal of sulfur from crude oil containing gross amounts of sulfur.

In the oxidation of organic sulfur compounds using hydrogen peroxide, the stochiometric reaction ratio is two moles of the hydrogen peroxide consumed per mole of sulfur reacted. In the practice of this invention the amount of oxidizing solution used should be such that it contains at least about two times the stochiometric amount to react the sulfur present in the fuel, preferably from about two to about four times. Greater amounts could be used, but only at increased cost since it has been found that improvement of sulfur oxidation is marginal at best when the amount is greater than four times the amount needed. Furthermore, to minimize peroxide losses by decomposition side reactions, the hydrogen peroxide concentrations in the oxidizer composition of this invention are preferably adjusted at low levels about 0.5 wt % to about 4 wt %. At these levels and the reaction temperature of about 95° C., it has been surprisingly discovered that the rapid and complete oxidation, and extraction, of the sulfur compounds from hydrocarbon feeds of relatively low sulfur content, compete favorably with the side reaction of peroxide decomposition, resulting in a practical and economic process for desulfurization of such fuels. Normally, the sulfur present would be calculated on the basis of it being a thiophenic sulfur. If the sulfur originally contained in the fuel is all dibenzothiophene or thiophene sulfur, then the removal from the oxidation/extraction step can result in less than about 10 ppm sulfur in the treated fuel. Other sulfur-containing compounds could, even though oxidized, cause additional extraction and removal steps to be performed depending upon the type of sulfur involved and the solubility in the fuel being treated.

Surprisingly, by limiting the water and hydrogen peroxide present and the reaction conditions of this invention, a practical process results with almost complete oxidation of organic sulfur compounds at high rates, with low peroxide concentrations, at relatively small peroxide excess over the stoichiometric requirement, and on feeds with relatively low sulfur content; all of these conditions being recognized in the art as kinetically unfavorable conditions. In addition to this unexpected result, it is accomplished with little loss of the expensive hydrogen peroxide to expected side reactions of self decomposition, or with other hydrocarbon species.

While the following invention is described in some detail, it must be understood by those skilled in the art that there is no intention on the part of the inventors hereof to abandon any part of the concepts of this invention with respect to the reduction of the organic sulfur in fuels and light oils.

DETAILED DESCRIPTION OF THE INVENTION

Figure 1:
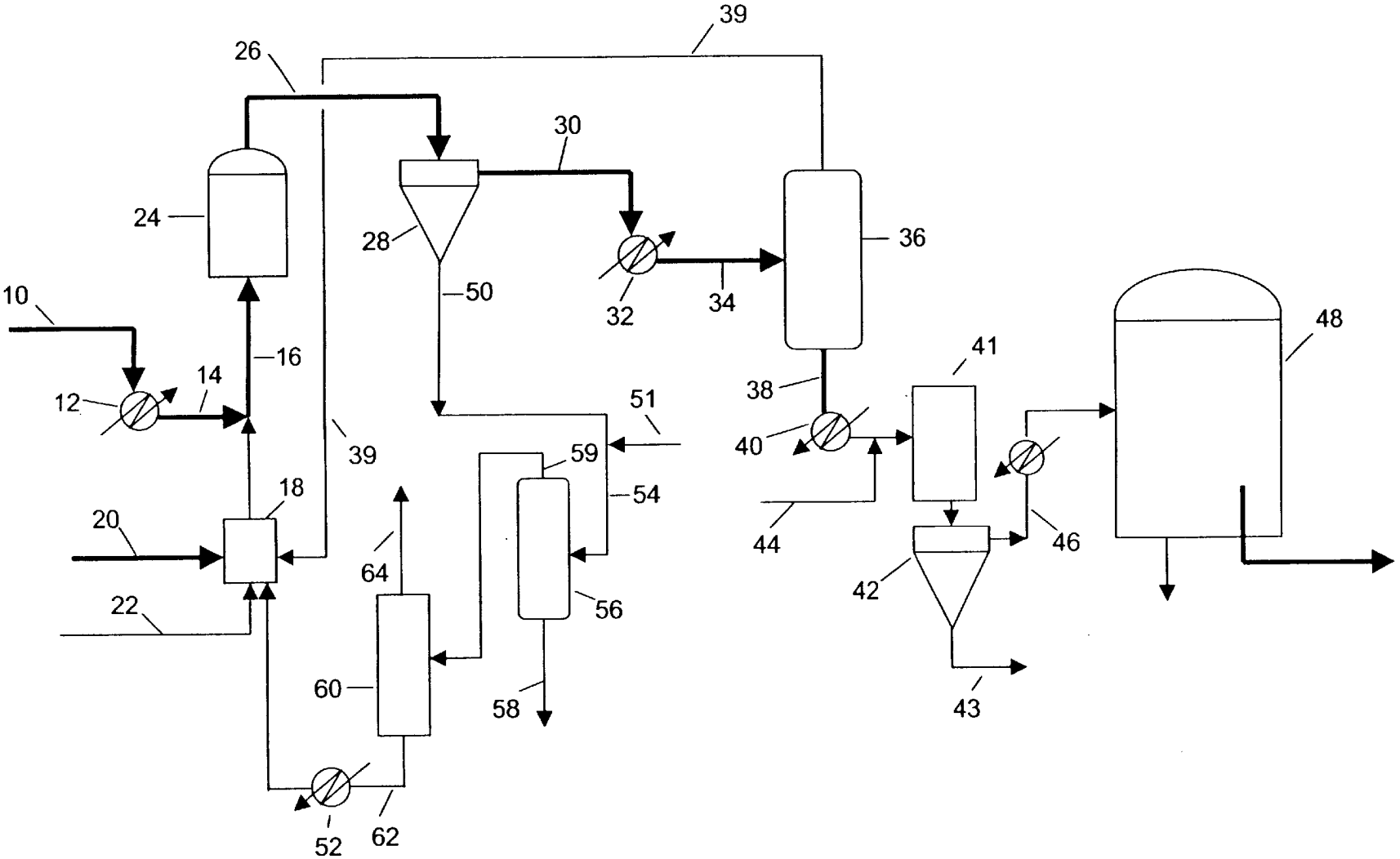
FIG. 1 shows a schematic flow sheet of the preferred process of the instant invention wherein the sulfur removal is accomplished by the oxidation/extraction step alone.

The invention summarized above will be more completely described as set forth hereinafter.

The process of this invention surprisingly oxidizes, almost quantitatively, organic sulfur compounds when polishing commercial diesel fuel, gasoline, kerosene, and other light hydrocarbons which have been refined, normally after a hydrogenation step in a hydrotreater where sulfur compounds are reduced and removed leaving a small number of sulfur species which are hydrogenated only with considerable difficulty. While the oxidation reaction of organic sulfur compounds with hydrogen peroxide and formic acid itself is well-known, it is surprising that such complete, almost quantitative, oxidation occurs in hydrocarbons containing a small amount of organic sulfur, up to about 1500 ppm, preferably from about 200 to about 1000 ppm, by reaction with an oxidizing/extraction solution having a low concentration of hydrogen peroxide, generally from about 0.5 to about 4 wt %, but preferably 0.5 to 3.5 wt %, or about 2% to about 3 wt % in the presence of a small amount of water, less than about 25 wt %, preferably less than about 20 wt %, but preferably in a range from about 8 wt % to about 20 wt %, but most preferably from about 8 wt % to about 14 wt %. The rest of the oxidizing solution is formic acid. The oxidation/extraction solution used in the practice of this invention will contain from about 75 wt % to about 92 wt % of carboxylic acid, preferably formic acid, and preferably 79 wt % to about 89 wt % formic acid. The molar ratio of acid, preferably formic acid, to hydrogen peroxide useful in the practice of this invention is at least about 11:1 and is preferably from about 12:1 to about 70:1 in the broadest sense, preferably from about 20:1 to about 60:1. This oxidizing solution is mixed with the hydrocarbon in an amount such that the stochiometric factor is an excess of two times the amount of hydrogen peroxide needed to react with the sulfur to a sulfone, preferably from about 2 to about 4; that is to say that there is greater than about four moles of hydrogen peroxide for each mole of sulfur in the fuel. The reaction stoichiometry requires 2 moles peroxide for each mole thiophenic sulfur. Thus, a stoichiometric factor (StF) of 2 would require 4 moles peroxide per mole sulfur. Of course, a higher factor can be used, but it gives no practical advantage.

It is a surprising and important discovery that the process of this invention does remove organic sulfur so effectively (i.e., at high rates and complete oxidation with low peroxide excess loss) given the low hydrogen peroxide concentration in the oxidizer/extractor solution and fuel feeds with low concentrations of sulfur. Those skilled in the art will appreciate that for proper mixing of two substantially immiscible liquids, the fuel oil and the aqueous oxidizer-extractor solution, the volumetric ratio of oil to water for the two phases should be lower than about 10:1 or, on the outside about 20:1. That means that adequate mixing can be achieved for example by mixing 100 ml fuel with 5–10 ml of an aqueous solution, but it would be extremely inefficient to attempt to mix in 0.5 to 1 ml of an aqueous solution (corresponding to a high concentration peroxide case) with 100 ml of a fuel. If the process required higher peroxide concentrations to work efficiently, as for some prior art processes, this condition for the volumetric ratio would result in very large amounts of peroxide at the end of the oxidation process not being used to oxidize the sulfur and thus available to decompose by side reactions. Such solutions would need to be recycled to increase the peroxide utilization. Before recycle, water would need to be removed to maintain a mass balance, and any further handling of unstable and unpredictable and unsafe peroxide solutions would be impractical. Dealing with such problems would be futile when compared with the practicality and benefits of the process of the present invention.

In preparing the oxidizing solution, hydrogen peroxide, which normally is available in aqueous solutions at concentrations of 30 wt %, 35 wt %, 50 wt % and 70 wt %, is mixed with formic acid which also has about 4% resident water present. Formic acid is normally available in a 96 wt % acid grade and, therefore, water is introduced into the system when the reactants are mixed. On occasion there may be an interest in adding water to the system. Even though it is of considerable interest in the successful operation of this invention to minimize the amount of water, handling and storing high concentrations of hydrogen peroxide is so great a safety hazard in a refinery that the preferred commercially available concentration would be the 35% peroxide solution even though technically, any source of hydrogen peroxide would be satisfactory as long as the ultimate oxidizing solution criteria detailed herein is followed.

Turning now to FIG. 1 for a detailed discussion of preferred embodiments of this invention, it will be understood that this detailed discussion is for points of example only and that it should not be taken to be a dedication or waiver of any other modifications or alterations of the process which remain insubstantially different from that as described here or claimed. Now turning to the process, the sulfur-containing fuel is introduced through line 10. If diesel fuel is the feed, for example, the current refinery-grade diesel fuel product has a maximum sulfur content of 500 ppm. Recent pronouncements from environmental authorities indicate that this allowable maximum is going to be drastically reduced. However, lower sulfur limits in the fuels being treated should not appreciably change the successful practice of this invention. The feed enters through line 10 and, if required, passes through heat exchanger 12, where it is brought to a temperature slightly above the desired reaction temperature. If the feed comes from a storage tank it may need to be heated, but if it comes from another operation in the refinery it may be hot enough to be used as it is or even cooled. In the practice of this invention the oxidation and extraction is carried out at a temperature of from about 50° C. to about 130° C., preferably from about 65° C. to about 110° C., and most preferably from about 90° C. to about 105° C. The feed is heated to a higher temperature so that, after passing through line 14 into line 16, where it is mixed with the oxidizing solution, the resulting reaction mixture will cool down to be within the reaction temperature range. The hydrogen peroxide enters the mixing tank 18 through line 20 where it is joined with the acid stream 22 to form the oxidizing solution, which is combined in line 16 with the heated feed entering through line 14. Recovered acid may also be added to the mixing tank 18 for reuse.

The feed and the oxidizing stream enter reactor 24 where the oxidation and extraction occurs, usually within about 5 to about 15 minutes contact, to satisfactorily oxidize the organic sulfur present and extract the oxidized compounds from the fuel. The reactor design should be such that agitation of the fuel and oxidizing/extracting solution should cause good mixing to occur such as with in-line mixers or stirred reactors, for example, operated in series. It is preferable that tie contact residence time be from about 5 to 7 minutes, with no more than about 15 minutes being required for complete conversion with the proper stochiometric factor and concentration within the oxidation solution when polishing a fuel containing low levels of sulfur compounds; such as a commercial diesel fuel. Greater times may be employed without departing from the scope of this invention, particularly when lower concentrations of formic acid are used. Suitable reactors for this step are a series of continuous stirred reactors (CSTR), preferably a series of 2 or 3 reactors. Other reactors which would provide proper mixing of the oxidizing solution with the hydrocarbon are known to the skilled engineer and may be used.

After the exothermic oxidation reaction occurs, the oxidized sulfur organic compounds become soluble in the oxidizing solution to the extent of their solubility in the hydrocarbon or aqueous solution and, thus, the solution not only causes the oxidation of the sulfur compounds in tile hydrocarbon fuel, but serves to extract a substantial part of these oxidized materials from the hydrocarbon phase into the oxidizing solution aqueous phase. The reaction product leaves the oxidation reactor 24 through line 26 as a hot two-phase mixture and proceeds to a settling tank 28 where the phases are allowed to separate with the hydrocarbon fuel phase having lowered sulfur content leaving the separator 28 through line 30. It is further heated in heat exchanger 32 and conveyed by line 34 to a flash drum 36 where the fuel is flashed to separate residual acid and water. An azeotropic solution of water and formic acid exits flash drum 36 through line 39 to be recycled and become part of the oxidizing solution's make-up in mixing tank 18. Alternatively, the water and acid may require additional processing (not shown) through a distillation step. Surprisingly, it has been discovered that the preferred high acid concentration oxidizer compositions of this invention with low water content also have the added benefit of having a higher extracting capacity for sulfones formed by the oxidation reaction.

The fuel product exits the flash drum 36 through line 38 and, as shown in FIG. 1, is cooled in heat exchanger 40 for subsequent filtering or treatment in holding tank 41 to remove any residual water, acid, or trace sulfur compounds which may remain that are subject to filtration removal. Some caustic or calcium oxide may be added to the fuel through line 44 to enter holding tank 41 to neutralize residual acids in the treated fuel. While any suitable material which would neutralize the acid may be used, use of dry calcium oxide (quicklime) would not only neutralize residual acid, but would also serve to dehydrate the fuel as can easily be determined by a skilled engineer. The presence of the solid calcium oxide provides facile removal of latent precipitates of residual oxidized sulfur compounds by seeding and filtration. Only a small amount is needed and can be easily determined by the skilled engineer from an analysis of the fuel in the hydrocarbon phase. Use of quicklime is technically preferred to neutralization by washing with caustic solution followed by salt drying. The fuel and solid calcium salts enter post treatment vessel 42 which can be any appropriate solids-liquids separator. From the post-treatment vessel 42, the fuel product exits through line 46 to storage tank 48. While the dehydration and final cleaning of the fuel can be accomplished in many ways known in the art, the foregoing is satisfactory for the practice of this invention. Any solids present exit post treatment vessel 42 through line 43 for appropriate use or disposal. The details of such an operation would be well-known to the process engineer.

The aqueous oxidation/extraction solution now carrying the oxidized sulfur compounds is removed from the separation vessel 28 through line 50, where it is preferably mixed with a hot gasoil from stream 51 and conveyed through line 54 through a flash distillation vessel 56 to strip the acid and water from the oxidized sulfur compounds, mostly in the form of sulfones, which are transferred by solubilities or fine dispersion into the hot gasoil and removed from the flash tank 56 through line 58 for ultimate treatment or disposal, e.g. into a coker. The conditions and unit operations mention here are known to the process engineer. When a gasoil is used in the practice of this invention as described here and later, it will normally be a refinery stream which is destined for disposal into a coker or the like. This gives this invention even another advantage because the removal of the sulfur from the fuel does not create another hazardous waste stream for difficult disposal. The addition of the gasoil at this point in the process assists in the flash separation of the water and formic acid flash tank 56, while gathering the sulfur-containing compounds with it and the sulfur already in a gasoil for proper disposal. The amount of gas oil used, of course, will be dependent upon the amount of sulfur-containing compounds in the process stream. The amount is not critical except that it is desirable that all of the sulfur compounds accompanying the aqueous stream be brought into the gasoil stream either by solution or dispersion therein. Also, since the environment within which the instant process is to be practiced will normally have streams of a gasoil at elevated temperature, such elevated temperature material can be used to enhance the flashing step in flash tank 56. Of course, those skilled in the art will recognize that if the temperature is too high, the aqueous materials could prematurely flash and, therefore, there must be a balancing of temperature and pressure at this point. It is an advantage, however, that such a stream could be used to raise the temperature of the material and thereby enhance the separation in flash tank 56. These are parameters that are familiar to the skilled engineer.

The overhead stream from the flash distillation tank 56 exits through line 59 and thence into azeotropic column 60, where the water is taken off overhead through line 64, and the recovered formic acid containing slight residual water is recycled through line 62, cooled in exchanger 52, back to the mixing vessel 18 for reuse. In the event the formic acid in line 39 requires additional separation from water, it too can be introduced into distillation column 60 along with the overhead stream in line 59.

As one way of treating the sulfur-containing compounds, FIG. 1 shows such compounds leaving vessel 56 through line 58 with the gasoil, when used, for further disposal into a coker (for example). Another disposal scheme is to transfer and incorporate the sulfones into hot asphalt streams. Another way is to distill off most of the acid and water for recycle, leaving at the bottom a more concentrated sulfone solution which can be chilled to precipitate and recover the solid sulfones by filtration. Other ways of acceptable disposal will be apparent to those skilled in the art.

Figure 2:
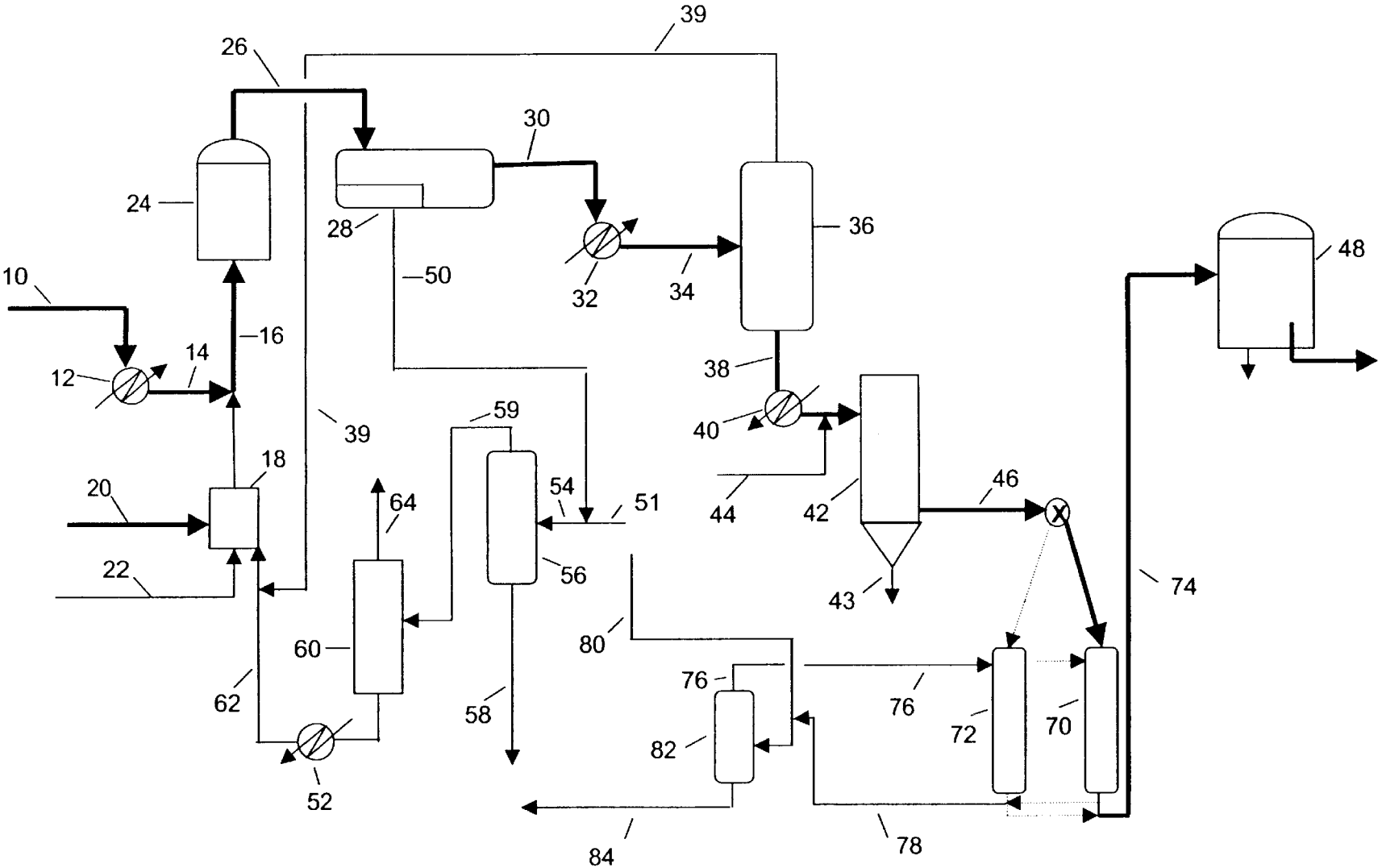
FIG. 2 is an alternative schematic flow sheet showing a preferred processing sequence for the additional removal of sulfur oxidation products which are soluble in the hydrocarbon fuel.

An alternative embodiment is shown on FIG. 2. The parts of equipment and lines shown also in FIG. 1 are numbered as in FIG. 1 for convenience. Here, the fuel is contaminated with thiophenes having other hydrocarbon moieties on the molecule creating hydrocarbon-soluble sulfone oxidation reaction product. Stream 46 exiting the neutralization-dehydration and filtering vessel 42 may still contain some oxidized sulfur compounds dissolved in the fuel. The presence of a residual oxidized sulfur level in the hydrocarbon indicates that an equilibrium solubility of these compounds exists in both the fuel oil and the aqueous acidic phase. This residual oxidized sulfur compound in the treated fuel can be removed by known liquid-liquid extraction techniques with suitable polar solvents such as, for example, methanol, acetonitrile, dimethylsulfoxide, furans, chlorinated hydrocarbons as well as with additional volumes of the aqueous acidic compositions of this invention. However, the solvent extraction approach for achieving low sulfur limits approaching zero is quite cumbersome, ineffective, impractical and expensive, especially when applied to fuel with such low starting sulfur contents which result from the initial oxidation/extraction step in the practice of this invention.

Surprisingly, an effective and practical way to achieve substantially complete removal of the residual oxidized sulfur compounds has been discovered. According to the process of this invention, the neutralized, dryed, and filtered fuel stream 46 is passed, alternatively, through packed or fluidized adsorption columns 70 or 72 over solid alumina (non-activated) having a relatively high surface area (such as that for fine granular material of 20–200 mesh size). Those skilled in the art could select a proper size based upon selected operation conditions and availability. Columns 70 and 72 are used in multiple adsorption-desorption cycles without significant loss of activity, but most importantly without the need to reactivate by high temperature treatment, such as calcination, which is conventionally employed in some industrial practices requiring the use of activated alumina. When sulfur breakthrough into the outlet stream of the column occurs at the selected concentration value in stream 74, stream 46 is diverted to a second column 72 operating in parallel.

Column 70 is now ready for the desorption cycle to remove the adsorbed oxidized sulfur, and regenerate the column for use again in the next adsorption cycle. The breakthrough concentration could be considered to be any sulfur concentration acceptable to the market, for example from 30 to about 40 ppm sulfur. The occurrence of a breakthrough is dependant on the volume of feed and dimension of the column relative to the size of the packing; all within the ability of the engineer skilled in the art.

The adsorption-desorption operations can be carried out in packed bed columns, circulating countercurrent fluidized alumina, mixer-settler combinations, and the like, as known to the skilled engineer. The adsorption cycle can be accomplished at ambient temperature, and at pressures to ensure reasonable flow rates through the packed column. Of course, other conditions may be used as convenient. The desorption cycle in column 70 starts by draining the fuel from the column 70 at the end of the adsorption cycle. The column 70 is washed with a lighter hydrocarbon stream such as, for example, a light naphtha, to displace remaining fuel wetting the solid adsorbent surfaces. Usually about one bed volume of naphtha is sufficient for this purpose. Steam or hot gas is passed through the column 70 to drive off the naphtha and to substantially dry the bed. The recovered fuel, drained fuel, naphtha wash, and the naphtha recovered by separating from the stripped step are all recovered.

The actual desorption of the oxidized sulfur compounds from the solid alumina is preferably accomplished by passing hot (50–80° C.) methanol from stream 76 through the packed column under sufficient pressure to ensure proper flow through the bed, while preventing flashing of methanol through the bed. This extraction can be achieved efficiently by either co-current, or counter-current flow relative to the flow used in the adsorption column. Part of the methanol extract can be recycled in the column to provide sufficient residence time to achieve high sulfone concentrations to avoid use of large volumes of methanol. Clean methanol is preferred to be the final wash before switching to column 70 back to the adsorption cycle. It has been determined that about one bed volume of methanol will extract about 95% of the total sulfone adsorbed in the alumina. One or two additional bed volumes of methanol may be used to substantially desorb all the sulfones, although this is not necessary for the cyclical process with the regeneration procedure taught in the practice of this invention. Before switching to the adsorption cycle, the methanol is drained off the column, clean methanol is passed through to ensure removal of the trapped methanol extract. It is preferably allowed to flash through the column by reducing the back pressure, and then the remaining methanol wetting the solid bed is driven off by steam or hot gas stripping.

The column is now ready to be returned to the adsorption cycle without significant loss in its adsorption efficiency and without the need to reactivate it by high temperature treatment. Any amount of water chemically bound on the alumina as a result of the procedures in this invention do not have a negative effect on the adsorption/desorption cyclic operation. Chemically bound water on alumina would otherwise disqualify it as an activated alumina adsorber. The final treated fuel oil product exits in stream 74 to product tank 48 with typically residual sulfur levels of less than about 10 ppm, approaching zero. The actual low level of residual sulfur can be decided by preselecting the breakthrough point of columns 70 and 72 taking into account cost considerations. Fewer bed volumes of feed through columns 70 and 72 during the adsorption portion of the cycle will normally result in lower sulfur concentrations in the end product. The oxidation of sulfur compounds in the first reaction cause levels of less than about 15 ppm in the final product to be possible.

The sulfur-rich methanol extract in stream 78 is mixed into a hot gasoil in stream 80 and flashed in tower 82 to recover the methanol in the overhead stream 76 for recycle. The methanol transfers the oxidized sulfur compounds, e.g., sulfones, into the gasoil at the bottom stream 84 for their further disposition such as, for example, into a coker.

Returning to FIG. 2, the aqueous oxidation material now carrying the oxidized sulfur is removed from the separation vessel 28 through line 50, where preferably it is mixed with a hot gasoil stream 51 and conveyed through line 54 to a flash distillation vessel 56 to strip the acid and water from the oxidized sulfur compounds, now mostly in the form of sulfones, which are transferred into the hot gasoil and removed from the flash tank 56 through line 58 for ultimate treatment or disposal into a coker, for example. The overhead stream from the flash distillation tank 56 exits through line 59 and thence into azeotropic distillation column 60, where the water is taken off overhead through line 64, and the recovered formic acid containing some residual water is recycled through line 62, cooled in exchanger 52, back to the mixing vessel 18 for reuse. The overhead in stream 39 could also be directed to the azeotropic distillation column 60 to make a further separation of the formic acid if desired.

There are many modifications available on the above described process, particularly after the separation of the oxidation/extraction solution containing the extract oxidized sulfur compounds, usually in the form of sulfones, from the treated hydrocarbon fuel. This treated fuel may have a sulfur concentration after the oxidation-extraction step of this invention of from about 120 to about 150 ppm in oxidized sulfur compounds depending upon the sulfur species that are present in the original material. The sulfur may be totally oxidized, but the resulting oxidized species may have a non-zero, variable solubility in the fuel and, therefore, not be totally extracted into the oxidizing solution. Substituted thiophenes, such as alkylated ($C_1$, $C_2$, $C_3$, $C_4$, etc.) dibenzothiophenes, when oxidized require more rigorous removal techniques than simpler compounds as described above such as the unsubstituted thiophenes. The alumina-methanol adsorption-desorption system of the invention described above is one advantageous preferred technique for removing the alkyl substituted sulfone oxidation products. The above-described process of this invention, when compared to the cost of a subsequent hydrogenation reaction in a hydrotreater to reduce the sulfur content, operates at relatively benign temperatures and pressures, and utilizes relatively inexpensive capital equipment. The process of this invention acts very effectively on the exact sulfur species, i.e., substituted, sterically hindered dibenzothiophenes, which are difficult to reduce by even severe hydrogenation conditions and are left in available commercial diesel fuels at levels of a little less than the regulatory limit of 500 ppm. With the current prospect of regulations reducing the maximum sulfur content of fuels, such as diesel fuel, to 10 to 15 ppm or less, the practice of this invention is very beneficial, if not necessary. This is particularly so in view of the counterintuitive use of low levels of hydrogen peroxide and the surprising recognition that the presence of excess water prohibits the successful complete-oxidation of the sulfur with low levels of hydrogen peroxide, which is a prerequisite to achieving residual sulfur levels approaching zero.

The foregoing exciting results are further demonstrated by the following examples, which are offered for purposes of illustration of the practice of this invention and for the understanding; not for the limitation thereof.

EXAMPLES

Unless otherwise stated, the following general experimental procedure applies to all of the examples. The feed is a sulfur-containing liquid hydrocarbon. Different feeds tested in these non-limiting examples were:

a. Kerosene (specific gravity 0.800) spiked with dibenzothiophene (DBT) to yield approximately 500 mg sulfur per kilogram b. Diesel fuel (specific gravity 0.8052) containing 400 ppm (i.e., mg/kg) total sulfur c. Diesel fuel (specific gravity 0.8052) spiked with DBT to yield approximately 7,000 ppm total sulfur d. A crude oil (specific gravity 0.9402), with 0.7 wt % S, diluted by ½ its volume with kerosene e. Synthetic diesel fuel (specific gravity 0.7979) made by mixing 700 grams of hexadecane with 300 grams of phenylhexane and dissolving into it 11 model sulfur compounds to yield a feed with about 1,000 ppm total sulfur and 6 nonsulfur-containing compounds to test their stability versus oxidation Each different batch of feed was analyzed by gas chromatography/mass spectroscopy (GC/MS). The oxidized fuel products were analyzed by the same technique, and the results were reported relative to the feed compositions. In general, 100 ml of feed was preheated to about 100° to 105° C. in a glass reactor equipped with: a mechanical stirrer, refluxing condenser, thermocouple, thermostats electrical heating mantle, addition port, at a back pressure of about ½ inch water. The oxidizer-extractor solution prepared at room temperature was then added and the reaction initiated. The temperature dropped after addition of this solution with the drop dependant upon the amount added. Within a short time the temperature in the reactor reached the desired operating temperature. The actual temperature varied by about +/−3° C. from the desired set operating temperature of about 95° C. Sulfur oxidation is an exothermic reaction, and the heating rate was adjusted manually, as needed, in examples using the higher sulfur feed. In general, it took about three minutes for the temperature to rise to the operating temperature after addition of oxidizing-extractor solutions in the tests operated at 95° C. Phase separation occurred and samples were taken from the oil phase at different time intervals of about 15 minutes and 1.5 hours after allowing the two liquid phases to disengage for from about 2 to about 10 minutes.

The oxidizer-extractor compositions in the preferred embodiment of this invention were prepared at room temperature by the procedure of adding: hydrogen peroxide to formic acid reagent (96% by wt. formic acid) in a beaker. The measured amount of 30 wt % hydrogen peroxide was added and mixed into the formic acid. Then, a measured amount of water, if applicable, was added and mixed in. The composition was ready for use within three to 10 minutes.

Example 1

A series of tests was carried out to evaluate the effect of the hydrogen peroxide stoichiometry factor (StF), hydrogen peroxide concentration, and formic acid concentration on oxidation and extraction of sulfur from kerosene spiked with dibenzothiophene to create a fuel containing about 500 ppm total sulfur. The test results demonstrate the preferred range of these parameters for the oxidizer-extractor composition surprisingly discovered to provide low-cost removal of the troublesome organic sulfur compounds. Limiting the water content of the oxidizing solution was discovered to be important. The volume of the oxidizer-extractor composition is variable, and depends on the values chosen for the other parameters. Thus, the total volume of the aqueous solution used to treat the fuel depends on StF, hydrogen peroxide and formic acid concentrations, and the total hydrogen peroxide amount depends, in turn, on the total amount of sulfur in the fuel feed and the StF.

The results for several values for the stoichiometric factor (StF), hydrogen peroxide, and formic acid concentrations are shown in Table 1. The oxidizer/extractant solution used in the test were prepared by mixing 30% aqueous hydrogen peroxide with formic acid (available as 96 wt %) in proportions as set forth in Table 1. The water weight percent concentration is obtained by difference. The kerosene was heated to 95° C., and the amount of solution was added to give the target StF. Samples were taken at 15 minutes after addition of these compositions to initiate the reaction. Additional samples taken at later time intervals, up to 1.5 hours, showed by analysis that little change occurs after the first 15 minutes.

TABLE 1

| | | | Sample taken at 15 minutes @ 95° C. set temperature | | | | | | |
|---|---|---|---|---|---|---|---|---|---|
| Order | StF | $H_2O_2$ wt % | Formic Acid wt % | Water wt % | 30% $H_2O_2$ ml | Formic Acid (96%) ml | Water ml | Tot. Vol. | % S Oxidized |
| 1 | 2.0 | 2.0 | 72.0 | 26.0 | 0.51 | 5.21 | 1.56 | 7.28 | 44.7 |
| 2 | 1.0 | 1.0 | 57.6 | 41.4 | 0.25 | 4.17 | 3.11 | 7.53 | 10.8 |
| 3 | 1.0 | 1.0 | 86.4 | 12.6 | 0.25 | 6.26 | 0.57 | 7.08 | 41.8 |
| 4 | 1.0 | 1.0 | 57.6 | 41.4 | 0.25 | 4.17 | 3.11 | 7.53 | 15.5 |
| 5 | 1.0 | 3.0 | 57.6 | 39.4 | 0.25 | 1.39 | 0.85 | 2.49 | 24.8 |
| 6 | 3.0 | 1.0 | 57.6 | 41.4 | 0.76 | 12.52 | 9.33 | 22.61 | 25.0 |
| 7 | 2.0 | 2.0 | 72.0 | 26.0 | 0.51 | 5.21 | 1.56 | 7.28 | 56.5 |
| 8 | 1.0 | 3.0 | 86.4 | 10.6 | 0.25 | 2.09 | 0.00 | 2.34 | 41.1 |
| 9 | 3.0 | 1.0 | 86.4 | 12.6 | 0.76 | 18.77 | 1.70 | 21.23 | 93.3 |
| 10 | 1.0 | 3.0 | 57.6 | 39.4 | 0.25 | 1.39 | 0.85 | 2.49 | 33.2 |
| 11 | 3.0 | 1.0 | 86.4 | 12.6 | 0.76 | 18.77 | 1.70 | 21.23 | 92.1 |
| 12 | 1.0 | 1.0 | 86.4 | 12.6 | 0.25 | 6.26 | 0.57 | 7.08 | 38.7 |
| 13 | 3.0 | 1.0 | 57.6 | 41.4 | 0.76 | 12.52 | 9.33 | 22.61 | 58.0 |
| 14 | 2.0 | 2.0 | 72.0 | 26.0 | 0.51 | 5.21 | 1.56 | 7.28 | 64.0 |
| 15 | 3.0 | 3.0 | 57.6 | 39.4 | 0.76 | 4.17 | 2.54 | 7.47 | 50.6 |
| 16 | 3.0 | 3.0 | 86.4 | 10.6 | 0.76 | 6.26 | 0.00 | 7.02 | 91.6 |
| 17 | 1.0 | 3.0 | 86.4 | 10.6 | 0.25 | 2.09 | 0.00 | 2.34 | 46.1 |
| 18 | 3.0 | 3.0 | 57.6 | 39.4 | 0.76 | 4.17 | 2.54 | 7.47 | 28.2 |
| 19 | 3.0 | 3.0 | 86.4 | 10.6 | 0.76 | 6.26 | 0.00 | 7.02 | 94.9 |
| 20 | 2.0 | 2.0 | 72.0 | 26.0 | 0.51 | 5.21 | 1.56 | 7.28 | 48.5 |

The experimental results of Table 1 were used to prepare a predictability model of the sulfur oxidation-extraction process in the relatively narrow preferred range for the key parameters. It has determined that the following model can be used to project the residual un-oxidized sulfur in the oil phase when the sulfur is present as the less reactive DBT, dibenzothiophene:

$$Y=2.07[H_2O_2][FA]-2.95[StF][FA]-4.81[FA]-183.97[H_2O_2]+127.11[StF]+843.42$$

Where:

Y is the residual un-oxidized sulfur in the oil product in ppm (mg/kg).

[$H_2O_2$] is the concentration of hydrogen peroxide in the oxidizer-extractor composition in weight percent.

[FA] is the concentration of formic acid in the oxidizer-extractor composition in weight percent.

The percent sulfur oxidation relative to the feed's 500 ppm sulfur can be calculated from the Y results as follows: X(% oxidation)=100−(Y/500)/100. Thus, for Y=30 ppm, X is 94% oxidation. For Y=8 ppm, X is 98.4% sulfur oxidation.

Figure 3:
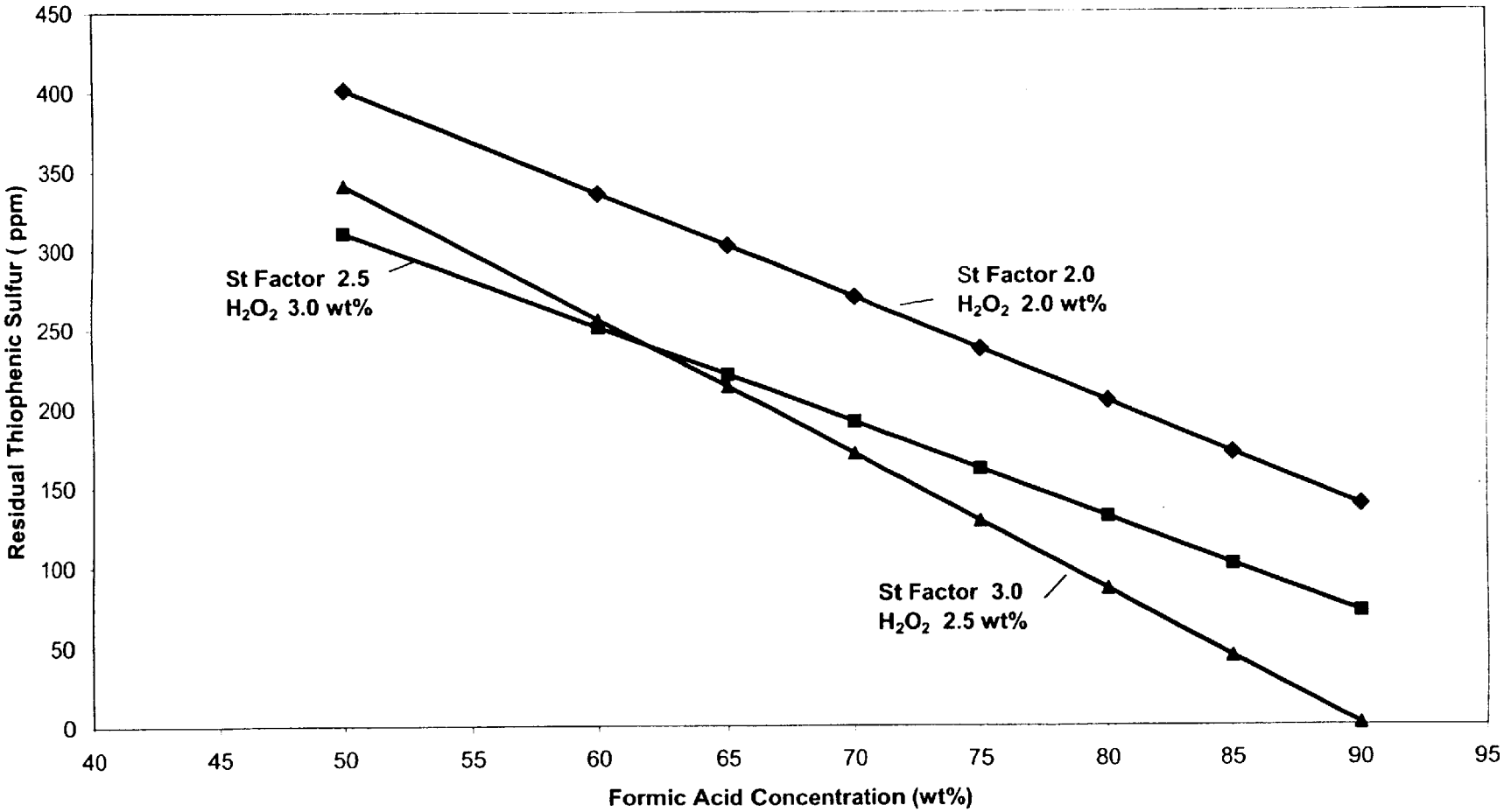
FIG. 3 shows the results obtained by plotting the residual sulfur in the fuel against the change in formic acid concentration in the oxidizing/extracting solution of this invention using the mathematical model developed from the experiments run in Example 1.

Using the model derived from the experiments of this example, the results are plotted in FIGS. 3–6. FIG. 3 demonstrates that for good kinetics and sulfur oxidation yields, the concentration of formic acid (i.e., limiting the amount of water) is a key, sensitive parameter. It can be readily seen, that as the concentration of formic acid increased, the oxidation of the sulfur increased with the volume of oxidant/extractant being dependant upon the St.F desired.

Figure 4:
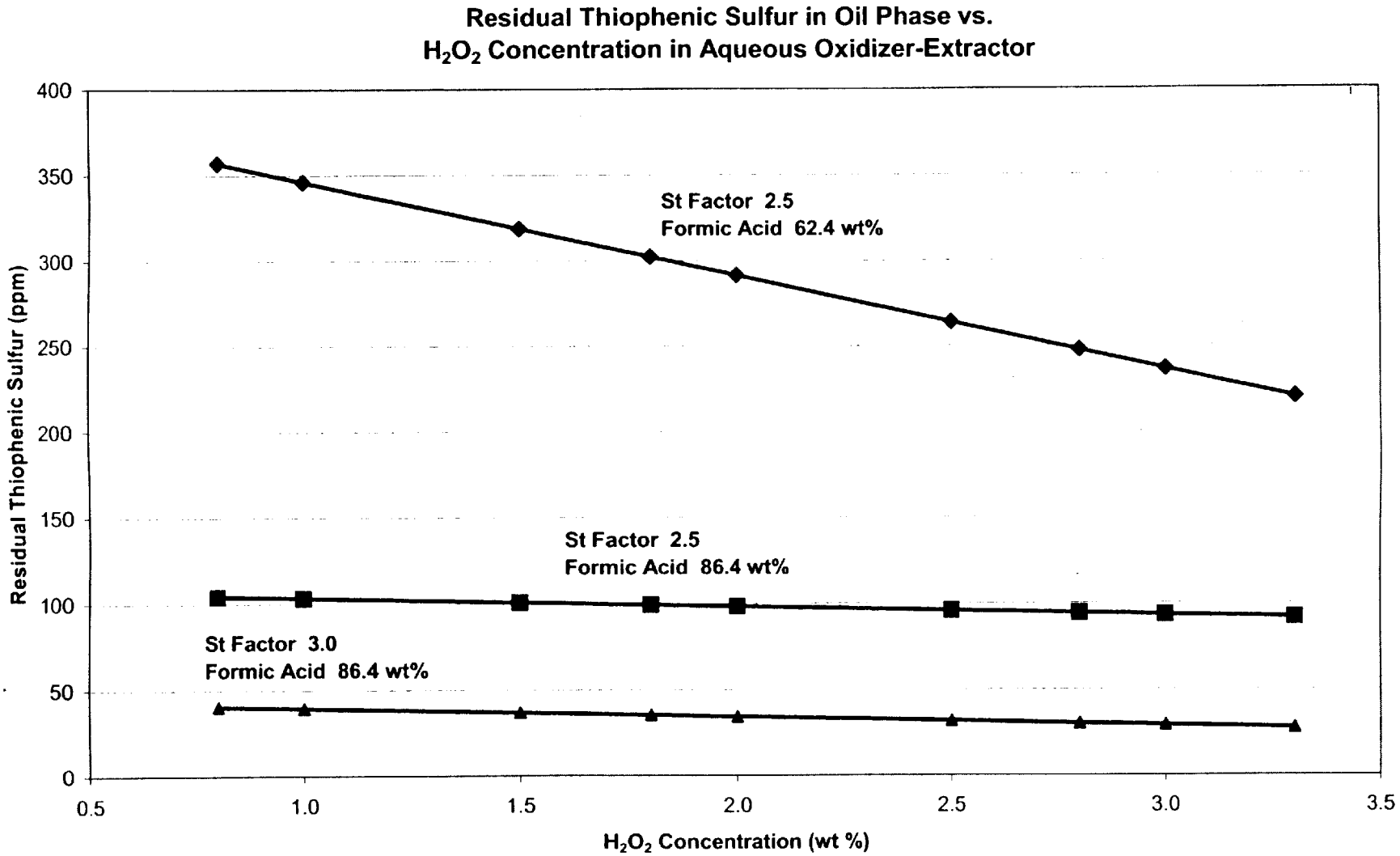
FIG. 4 shows the results obtained by plotting the residual sulfur in the fuel against the change in preferred hydrogen peroxide concentration in the oxidizing/extracting solution of this invention using the mathematical model developed from the experiments run in Example 1.

FIG. 4 shows that oxidation is relatively insensitive to the concentration of hydrogen peroxide in the compositions with limited amount of water (i.e., high formic acid concentrations). This is surprising discovery in view of prior art. However, FIG. 4 shows that at higher water concentrations (i.e., lower acid concentrations), sulfur oxidation increases with increasing hydrogen peroxide concentrations, clearly a disadvantage to operating a process in such environments. The sulfur oxidation insensitivity to changes in hydrogen peroxide concentration in the low range of 1 to about 4 wt % $H_2O_2$ of this invention for the preferred solution with high formic acid concentration is a clear advantage over the prior art. The advantage of lower peroxide compositions with undiminished performance results in reduced losses by side reactions when recycles are contemplated, efficiency of mixing of the two substantially immiscible liquid phases in the reactor and phase separation at the end of the reaction, and the feasibility of doing the oxidation in two countercurrent stages to maximize peroxide utilization.

Figure 5:
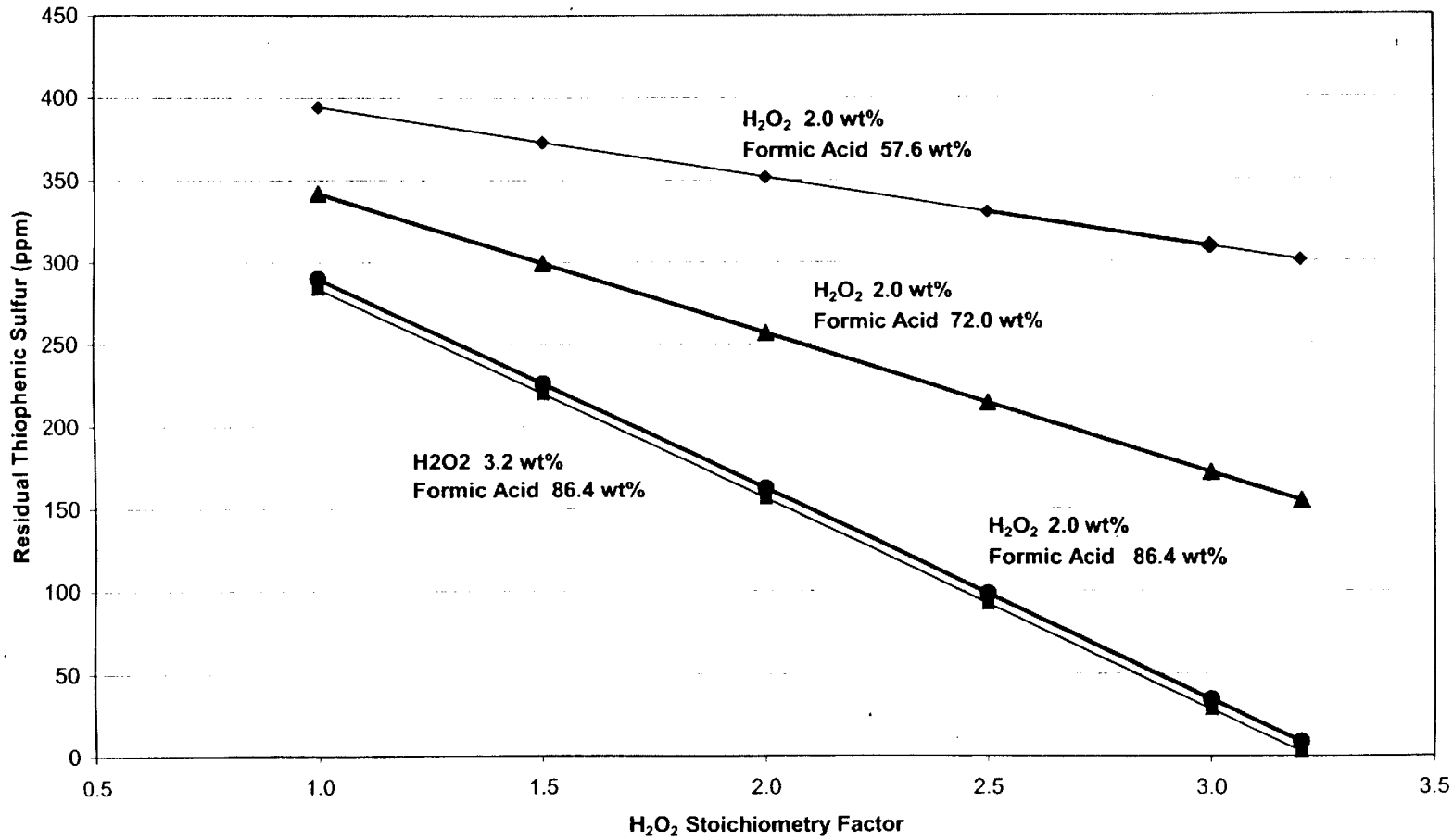
FIG. 5 shows the results obtained by plotting the residual sulfur in the fuel against the hydrogen peroxide stoichiometry factor at different formic acid concentrations in the oxidizing/extracting solution of this invention using the mathematical model developed from the experiments described in Example 1.

FIG. 5 shows that for favorable sulfur oxidation levels at fast reaction rates, the preferred stoichiometry factor falls in the range of from 2.5 to 3.5, and most preferred from 3 to 3.3 for this system with DBT as the sole thiophenic sulfur compound. The stoichiometric requirement is two moles of hydrogen peroxide to oxidize one mole of thiophenic sulfur. The StF is an indicator of excess peroxide required (e.g., StF=2 means 4 moles peroxide per mole sulfur) to achieve high sulfur oxidation and extraction, at high rates practical for a commercial process. Hydrogen peroxide undergoes decomposition from side reactions, and the dilute compositions of this invention minimize losses caused by such side reactions, and the overall process does not rely on using large volumes of more concentrated hydrogen peroxide. Concentrated solutions would require extensive recycle and thus being subjected to losses. This can also be appreciated from the plot in FIG. 5 which shows that attempting to increase sulfur removal by doubling the StF in compositions rich in water (57.6% formic acid) is ineffective, in clear contrast to acid-rich compositions (86.4% formic acid), as taught by this invention.

Figure 6:
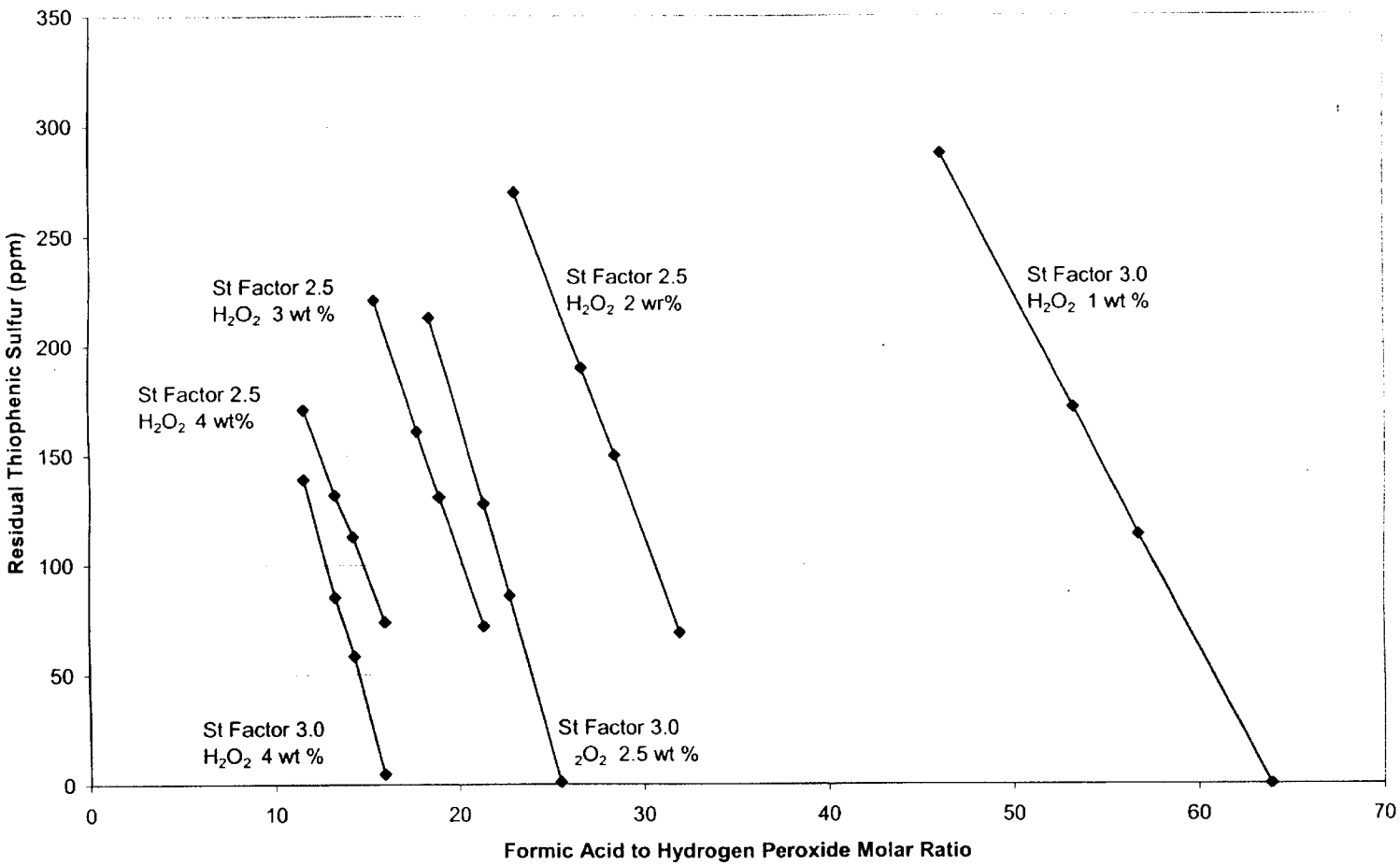
FIG. 6 shows the effect of the mole ratio of formic acid to hydrogen peroxide at different stoichiometric factors on the sulfur oxidation based upon the data developed and described in Example 1.
Figure 7:
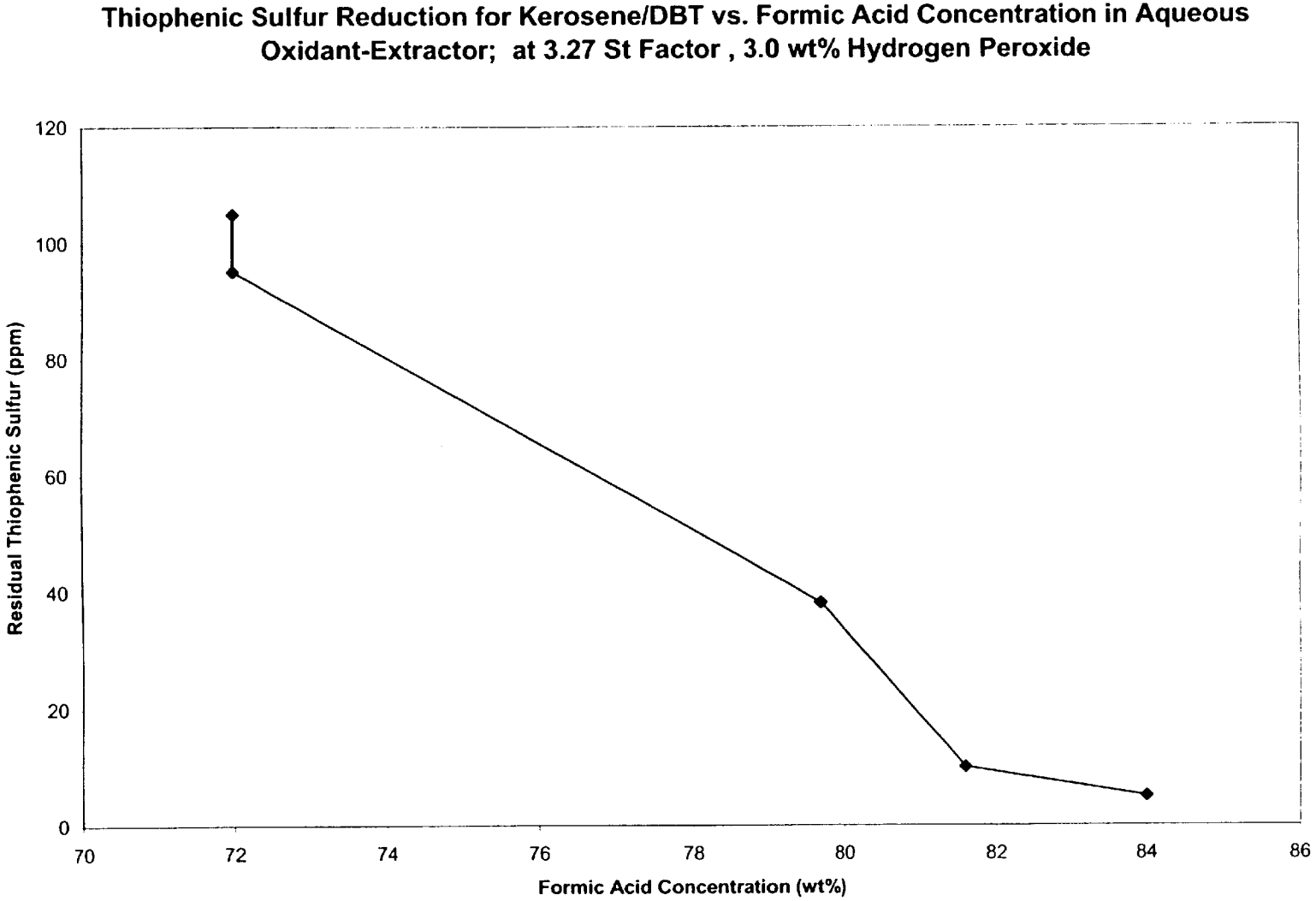
FIG. 7 shows the results obtained by the experimental results by plotting the residual sulfur in the fuel against the formic acid concentration at a fixed stoichiometric (St.F) factor and hydrogen peroxide content using the data gathered from the experiments described in Example 2.

FIG. 6, using the predictive model created from the experiments run and described on Table 1 shows the relationship between the molar ratio of the formic acid to hydrogen peroxide, and the removal of the thiophenic sulfur from the fuel being treated. It shows clearly that at different concentrations of hydrogen peroxide and stoichiometry factors, that the ratio should be at least about 11 to 1, and preferably considerably higher than that with the broad range being from about 12 to about 70 and a narrower preferred range between about 20 and about 60. It also shows that little, if any, advantage is created by including 4% hydrogen peroxide in the oxidation/extraction solution.

Example 2

Another series of experiments run as described above was carried out to demonstrate the efficient single-step oxidation/extraction of sulfur from a kerosene feed spiked with DBT to about 500 ppm total sulfur. Samples were taken at 15 minutes and after 1.5 hours from the organic phase after allowing the two liquid phases to disengage at the operating temperature. The samples were not further washed or otherwise treated before analysis. The results are shown in Table 2. It can be seen that oxidation in excess of 98% is easily achievable. It can also be seen that there is practically no further change in the residual sulfur concentration after the first 15 minutes of reaction for the compositions high in acid. It can also be seen that the results using compositions with high water content are more variable and less reproducible. The reaction-extraction was completed within the first 15 minutes, in contrast with results at the higher water compositions where in some instances there had been oxidation occurring after the 15-minute time period. FIG. 6 again demonstrates very clearly the importance of limiting the amount of water in the oxidation solution of this invention by using high acid concentrations at constant, relatively low, concentration of hydrogen peroxide.

TABLE 2

Oxidizer Compositions for the $H_2O_2$ Diesel System

| | | Formic A. | | | | | | Residual Sulfur | | Sulfur Oxidation | |
|---|---|---|---|---|---|---|---|---|---|---|---|
| $H_2O_2$ StF | $H_2O_2$ 30% ml | (96%) ml | Add Water g | Ttl Vol. ml | $H_2O_2$ wt % | Formic A. wt % | Water wt % | 15 min ppm | 1.5 hrs ppm | 15 min % | 1.5 hrs % |
| 3.27 | 0.83 | 18.19 | 4.623 | 23.65 | 1.0 | 76.8 | 22.2 | 85 | 60 | 83 | 88 |
| 3.27 | 0.83 | 6.74 | 0.760 | 8.33 | 2.8 | 79.7 | 17.5 | 150 | 35 | 70 | 93 |
| 3.27 | 0.83 | 9.44 | 1.433 | 11.70 | 2.0 | 79.7 | 18.3 | 9 | 10 | 98 | 98 |
| 3.27 | 0.83 | 9.66 | 1.156 | 11.65 | 2.0 | 81.6 | 16.4 | 10 | 10 | 98 | 98 |
| 3.27 | 0.83 | 9.66 | 1.156 | 11.65 | 2.0 | 81.6 | 16.4 | 10 | 10 | 98 | 98 |
| 3.27 | 0.83 | 9.95 | 0.809 | 11.59 | 2.0 | 84.0 | 14.0 | 6 | 7 | 99 | 99 |
| 3.27 | 0.83 | 5.68 | 1.387 | 7.90 | 3.0 | 72.0 | 25.0 | 90 | 120 | 82 | 76 |
| 3.27 | 0.83 | 5.68 | 1.387 | 7.90 | 3.0 | 72.0 | 25.0 | 110 | 81 | 78 | 84 |
| 3.27 | 0.83 | 6.29 | 0.647 | 7.77 | 3.0 | 79.7 | 17.3 | 35 | 42 | 93 | 92 |
| 3.27 | 0.83 | 6.44 | 0.462 | 7.74 | 3.0 | 81.6 | 15.4 | | 10 | | 98 |
| 3.27 | 0.83 | 6.63 | 0.231 | 7.70 | 3.0 | 84.0 | 13.0 | 5 | 5 | 99 | 99 |

TABLE 2-continued

Oxidizer Compositions for the $H_2O_2$ Diesel System

| $H_2O_2$ StF | $H_2O_2$ 30% ml | Formic A. (96%) ml | Add Water g | Ttl Vol. ml | $H_2O_2$ wt % | Formic A. wt % | Water wt % | Residual Sulfur 15 min ppm | Residual Sulfur 1.5 hrs ppm | Sulfur Oxidation 15 min % | Sulfur Oxidation 1.5 hrs % |
|---|---|---|---|---|---|---|---|---|---|---|---|
| 3.27 | 0.83 | 6.82 | 1.849 | 9.50 | 2.5 | 72.0 | 25.5 | 23 | 24 | 95 | 95 |
| 3.27 | 0.83 | 7.55 | 0.962 | 9.34 | 2.5 | 79.7 | 17.8 | 120 | 70 | 76 | 86 |
| 3.27 | 0.83 | 7.73 | 0.740 | 9.30 | 2.5 | 81.6 | 15.9 | 20 | 25 | 96 | 95 |
| 3.27 | 0.83 | 7.96 | 0.462 | 9.25 | 2.5 | 84.0 | 13.5 | 10 | 10 | 98 | 98 |
| 3.27 | 0.83 | 7.96 | 0.462 | 9.25 | 2.5 | 84.0 | 13.5 | 10 | 9 | 98 | 98 |

Example 3

Tests were carried out using the previously described procedure with a commercial diesel feed represented to contain about 400 ppm total sulfur, mostly thiophenic, at high acid concentration 86.4 wt % formic acid, (90 wt % of 96% formic acid grade), and 2.5 wt % hydrogen peroxide. The StF was 3.3. The composition was made by mixing 8.19 ml formic acid (96%), 0.83 ml 30% hydrogen peroxide, and 0.815 ml distilled water.

The GC chromatograms were used to compare the treated product to the feed to show the substantially complete disappearance of the thiophenic sulfur compounds from the oil phase (diesel fuel). Analysis determined that substantially all the sulfur in the feed was trimethylbenzothiophenes. The product after oxidation reaction contained practically zero thiophenic sulfur. The sulfones formed were recovered from the aqueous extract and identified as being primarily trimethyl benzothiophene sulfones. This composition proved to give effective (complete) oxidation of the organic sulfur in commercial diesel fuel which contains sulfur in the form of alkylated dibenzothiophenes, rather than DBT.

Example 4

Tests were carried out using commercial diesel fuel containing about 400 ppm total sulfur, mostly $C_3$, $C_4$ benzothiophenes, further spiked with dibenzothiophene (DBT) to a final total sulfur concentration of about 7,000 ppm. In three tests the spiked diesel feed was treated with three different oxidizer-extractor solutions with the StF, hydrogen peroxide, formic acid (water) parameters adjusted in the ranges taught in this invention. Formic acid concentration was fixed at 86.4 wt % in these compositions. The stoichiometry factor was 2.5. Runs were made with hydrogen peroxide concentrations of 1.5, 2.0 and 3 wt % by changing the amount of water, respectively 12.1, 11.6 and 10.6 wt % and varying the total volume of oxidizer-extractor solution. the variations were within the preferred range for these variables for this invention. The experimental procedure described above was modified by adding one fourth of the total oxidizer composition at four 10-minute intervals over a period of 30 minutes. This was done to reduce the temperature drop created from the operating set by an addition of a larger volume of solution at ambient conditions and to allow balancing it with the temperature rise due to the exotherm created by the higher sulfur content than those tests run with commercial diesel fuel. Samples were taken at the end, after about 20 minutes following the last addition of oxidizer (total time 50 minutes). The GC/MS analytical results showed that in all cases within this preferred compositional range, the oxidation of the thiophenic species was substantially complete and rapid even though the sulfur was present at high concentrations. It also demonstrated the previously noted relative insensitivity to the concentration of hydrogen peroxide at this high acid concentration and for constant StF.

This example shows that the dilute peroxide/high acid and low water composition of this invention is very effective in oxidizing almost to completion a number of different thiophenic compounds typically present in fuels, and the less reactive DBT even when extended to much higher sulfur levels in the feed applications. DBT sulfone is also effectively extracted, being significantly less soluble in diesel fuel. The residual equilibrium concentration of about 150 ppm sulfur was due to the higher solubility of the alkyl-substituted sulfones in diesel fuel.

Example 5

Tests were carried out with a commercial diesel fuel containing about 250 ppm total thiophenic sulfur, and most of it as $C_3$ to $C_5$ substituted DBTs. Six batches of 200 ml each were oxidized as in previous examples with oxidizer compositions of StF=3, $H_2O_2$ concentration=2 wt %, and formic acid concentrations of 85 wt % (added as 96% acid with 16.4 wt % water). All oxidized diesel product batches were mixed together, washed twice with water (200 parts fuel:100 parts water). The washed diesel was separated completely from free water, then neutralized and dried by slurrying with 1 wt % calcium oxide and filtered through a 0.45 micron filter element. The oxidized, clean diesel product was then analyzed by GC/MS and for total sulfur. The GC/MS results showed a substantially complete oxidation of all thiophenic sulfur to sulfones. However, the total sulfur analysis showed a residual sulfur concentration of about 150 ppm in the totally oxidized diesel. This residual amount of sulfur was due to the variable, non-zero solubility of $C_3$ and $C_5$ substituted DBT sulfone compounds. Unsubstituted DBT sulfone is substantially insoluble in diesel at ambient temperature and is, therefore, extracted by the oxidizer/extractor solution. The higher the alkyl substitution in the DBT ring, the higher the solubility of the resulting sulfones in diesel will be.

To remove the residual oxidized sulfur to the desired levels of less than 15 ppm, i.e., to achieve deep desulfurization, the above oxidized diesel was passed through an alumina bed in a packed column. Activated alumina (Brochmann 1 from Aldrich Chemical Company) was used for this purpose after a preparation that serves to deactivate it compared to other refinery conventional applications. The fine alumina was prepared as follows before packing the column. Alumina was mixed and washed with copious amounts of water in a beaker and allowed to stand in water overnight. Then it was stirred and the finer particles were decanted off before they had a chance to settle. This was repeated several times. The alumina slurry on the bottom of the beaker was then wet (water) screened and washed with large amounts of water to collect for use only the −75 to +150 micron size fraction. The water-wet slurry was decanted, then slurried and decanted repeatedly with methanol to remove the free water, then the procedure was repeated with acetone to remove the methanol. The acetone-wet alumina was allowed to dry at ambient conditions to a dry, free flowing fine granular material. About 65 grams of this now neutral, deactivated alumina material was packed in a 1.5 cm inner diameter, jacketed column to a packed volume of about 60 cc.

About 750 ml of the above oxidized diesel was passed through the column, top-to-bottom, and the eluent was collected in separate, sequentially-numbered 50 ml volume samples. These were analyzed for total sulfur and the results were shown in Table 3. It can be seen that the residual total sulfur in the diesel is as low as 5 ppm and that the 15 ppm preferred limit is reached after somewhere between 450 and 500 ml of feed have passed through the column. It can also be seen that blending the first 12 of the 50 ml samples gave 600 ml of eluent with an average sulfur concentration of 13.5 ppm residual sulfur, still under the 15 ppm preferred limit. Those skilled in the art will recognize that scaled up tests would give yet much better results, i.e., higher bed volume numbers before the breakthrough point by at least four times. The scaled up tests would not be disadvantaged by the very clear and obvious negative wall effects on the quality of the eluent when using a column with a 1.5 cm diameter and a bed length of about 33 cm. Also, the extraction will be more effective (higher bed volumes of feed could be treated before the sulfur breakthrough) if the flow is from the bottom up.

TABLE 3

| | 50 ml fraction | ppm S | cum avg ppm S |
|---|---|---|---|
| oxidized diesel | 0 | 150 | |
| 1st cycle | 1 | 5 | 5.0 |
| | 2 | 6 | 5.5 |
| | 3 | 6 | 5.7 |
| | 4 | 7 | 6.0 |
| | 5 | 8 | 6.4 |
| | 6 | 9 | 6.8 |
| | 7 | 10 | 7.3 |
| | 8 | 12 | 7.9 |
| | 9 | 14 | 8.6 |
| | 10 | 18 | 9.5 |
| | 11 | 26 | 11.0 |
| | 12 | 41 | 13.5 |
| | 13 | 60 | 17.1 |
| | 14 | 90 | 22.3 |
| | 15 | 132 | 29.6 |
| 3rd cycle | 1 | 4 | |
| | 4 | 7 | |

At the end of the adsorption cycle, the column was drained, then washed (top to bottom) with 60 ml cyclohexane to displace residual diesel, then dried by passing nitrogen through the column while circulating heating fluid through the jacket of the column at about 50° C. Following, methanol was passed, top-to-bottom, through the heated column and three sequential batches of methanol extract, 50 ml each, were collected and analyzed for sulfur and to identify the sulfur species. GC/MS analysis showed that the extracted species were all DBT sulfones, mostly C3–C5 substituted. It also showed that about 95% of the total sulfur was eluted in the first 50 ml methanol batch.

Before switching to the second adsorption cycle, the methanol from the column was drained, the column was then washed with 50 ml acetone to facilitate its drying from methanol and acetone by passing through nitrogen in lieu of steam in a commercial application. The adsorption-desorption cycle was repeated three times. As the data show, the sulfur in the first and fourth 50 ml eluent batch for the third cycle were 4 and 7 ppm, respectively, and just about the same as for the corresponding eluent samples in the first cycle. Thus, alumina which has first been deactivated by contacting with water can be used effectively in the cyclic procedure taught in this invention without the need for high temperature re-activation, such as by calcining.

The foregoing description of the invention and the specific examples described demonstrate the surprising nature of the oxidizing/extracting solution and the process for desulfurizing hydrocarbon fuels, especially those having low levels of sulfur present. The above-described description is offered for purposes of disclosing the advantages of the instant invention for use in desulfurizing the aforementioned fuel oils. Having been taught such process by the above discussion and examples, one of ordinary skill in the art could make modifications and adaptations to such process without departing from the scope of the claims appended hereto. Accordingly, such modification, variations and adaptations of the above-described process and compositions are to be construed within the scope of the claims which follow.

What is claimed is:

1. A process for removing sulfur compounds from hydrocarbon fuels, comprising the steps of:

contacting the sulfur containing fuel with an aqueous oxidizing solution comprising hydrogen peroxide, and formic acid in a mole ratio of at least about 11:1 formic acid to hydrogen peroxide and having less than about 25 wt % water, in an amount such that the hydrogen peroxide present is greater than about two times the stoichiometric amount required to convert the sulfur compounds present to corresponding sulfones, at a temperature of from about 50° C. to about 130° C. to form a hydrocarbon fuel phase from which sulfur has been removed and an aqueous phase containing oxidized sulfur extracted from the hydrocarbon fuel phase;

separating the aqueous phase containing the extracted sulfur compounds from the hydrocarbon fuel phase; and recovering the hydrocarbon phase containing the fuel having reduced sulfur content.

2. The process of claim 1 wherein the mole ratio of formic acid to hydrogen peroxide is from about 20:1 to about 60:1.

3. The process of claim 1 also including the steps of:

flashing the aqueous phase to separate the formic acid and water from the oxidized sulfur compounds;

distilling the aqueous phase to remove water from the acid; and recovering the acid.

4. The process of claim 3 also including the step of recycling the recovered acid as part of the acid to use in the aqueous oxidizer solution.

5. The process of claim 1 wherein the formic acid is present in the oxidizing solution in an amount of from about 75 wt % to about 92 wt %, and the hydrogen peroxide is present in an amount of from about 0.5% to about 4 wt %.

6. The process of claim 1 wherein the oxidation step occurs in less than about 15 minutes contact time.

7. The process of claim 1 wherein the amount of the oxidizing solution added is sufficient to provide a stoichiometric excess of from about 2 to about 4 times the amount required to oxidize the sulfur present.

8. The process of claim 7 wherein the stoichiometric excess is from about 3.0 to about 3.3 times the amount required to oxidize the sulfur present in the hydrocarbon fuel.

9. The process of claim 1 including the further step of:

treating the recovered hydrocarbon phase with a sufficient quantity of calcium oxide to neutralize any residual acid therein;

and separating the neutralized fuel from the calcium oxide.

10. A process for removing sulfur compounds from diesel fuel comprising the steps of:

contacting the diesel fuel at a temperature of from about 90° C. to about 105° C. for a period of time up to about 15 minutes with an oxidizing solution comprising:

from about 79 wt % to about 89 wt % formic acid, from about 2 wt % to about 3 wt % hydrogen peroxide, and from about 8 wt % to about 14 wt % water:

in an amount such that the molar ratio of formic acid to hydrogen peroxide is from about 20:1 to about 60:1, wherein the amount of oxidizing solution added is such that there is a stoichiometric excess of hydrogen peroxide necessary to oxidize the sulfur present in the diesel fuel in an amount of from about 2.5 to about 3.5 times the amount needed to oxidize the sulfur in the fuel;

extracting, during the oxidizing step, the oxidized sulfur compounds from the diesel fuel into the aqueous oxidizing solution to form a hydrocarbon phase and an aqueous phase;

separating the aqueous phase containing the extracted sulfur compounds from the hydrocarbon fuel phase;

neutralizing any residual acid in the fuel;

recovering the neutralized diesel fuel containing less than about 25 ppm sulfur; and recovering the formic acid from the aqueous phase.

11. The process of claim 10 wherein the formic acid is recovered by the additional steps of:

flashing the aqueous phase to separate the formic acid and water from the oxidized sulfur compounds as an overhead stream;

distilling the overhead stream to remove water from the formic acid; and recycling the formic acid for reuse in the oxidizing solution.

12. A process for removing sulfur compounds from diesel fuel comprising the steps of:

contacting the diesel fuel at a temperature of from about 90° C. to about 105° C. for a period of time up to about 15 minutes with an oxidizing solution comprising:

from about 79 wt. % to about 89 wt % formic acid, from about 2 wt. % to about 3 wt. % hydrogen peroxide, and from about 8 wt % to about 14 wt % water:

in an amount such that the molar ratio of formic acid to hydrogen peroxide is from about 20:1 to about 60:1, wherein the amount of oxidizing solution added is such that there is a stoichiometric excess of hydrogen peroxide necessary to oxidize the sulfur present in the diesel fuel in an amount of from about 2.5 to about 3.5 times the amount needed to oxidize the sulfur in the fuel;

extracting, during the oxidizing step, the oxidized sulfur compounds from the diesel fuel into the aqueous oxidizing solution to form a hydrocarbon phase and an aqueous phase;

separating the aqueous phase containing the extracted sulfur compounds from the hydrocarbon fuel phase;

neutralizing any residual acid in the fuel;

recovering the neutralized diesel fuel containing less than about 25 ppm sulfur;

adding a gasoil to the separated aqueous phase; and, recovering the formic acid from the aqueous phase;

flashing the aqueous phase to separate the formic acid and water from the oxidized sulfur compounds as an overhead stream;

distilling the overhead stream to remove water from the formic acid; and recycling the formic acid for reuse in the oxidizing solution.

13. The process of claim 10 wherein the diesel contains up to about 500 ppm sulfur by weight.

14. A process for removing sulfur compounds from a hydrocarbon fuel containing benzothiophenes, dibenzothiophenes, and alkyl-substituted benzothiophenes and dibenzothiophenes comprising the steps of:

contacting, at a temperature of from about 50° C. to about 130° C., the sulfur-containing fuel with an aqueous oxidizing solution comprising hydrogen peroxide and formic acid in a mole ratio of at least about 11:1, formic acid to hydrogen peroxide, and having less than about 25 wt % water, in an amount such that the hydrogen peroxide present in greater than about 2 times the stoichiometric amount required to convert the sulfur compounds present to corresponding sulfones whereby a hydrocarbon fuel phase is formed which contains oxidized alkyl-substituted benzothiophenes and dibenzothiophenes, as sulfones, and an aqueous phase containing substantially all the oxidized benzothiophenes and dibenzothiophenes;

separating the aqueous phase containing the extracted, oxidized benzothiophene and dibenzothiophene sulfur compounds from the hydrocarbon phase containing oxidized alkyl-substituted benzothiophenes and dibenzothiophenes;

flashing the hydrocarbon phase to remove remaining formic acid and water from the hydrocarbon phase;

neutralizing and dewatering the hydrocarbon phase;

passing the hydrocarbon phase through a bed of an alumina adsorbent to adsorb the oxidized alkyl-substituted benzothiophenes and dibenzothiophenes from the fuel; and recovering the fuel having substantially lowered sulfur content from the oxidized sulfur compound.

15. The process of claim 14 wherein the drying and neutralization is accomplished by adding calcium oxide to the hydrocarbon phase fuel; and filtering the fuel to remove the solids from the fuel.

16. The process of claim 14 including the additional steps of:

cooling the hydrocarbon phase between the flashing step and the neutralizing and dewatering step; and adding the calcium oxide to the hydrocarbon stream prior to introduction into a post-treatment vessel serving as a solids liquids separator.

17. The process of claim 14 wherein the sulfur is present in an amount up to about 7000 ppm by weight sulfur.

18. A process for removing sulfur compounds from hydrocarbon fuels, comprising the steps of:

contacting the sulfur containing fuel with an aqueous oxidizing solution comprising hydrogen peroxide, and formic acid in a mole ratio of at least about 11:1 formic acid to hydrogen peroxide and having less than about 25 wt % water, in an amount such that the hydrogen peroxide present is greater than about two times the stoichiometric amount required to convert the sulfur compounds present to corresponding sulfones, at a temperature of from about 50° C. to about 130° C. to form a hydrocarbon fuel phase from which sulfur has been removed and an aqueous phase containing oxidized sulfur extracted from the hydrocarbon fuel phase;

separating the aqueous phase containing the extracted sulfur compounds from the hydrocarbon fuel phase;

recovering the hydrocarbon phase containing the fuel having reduced sulfur content;

adding a gasoil to the separated aqueous phase;

flashing the aqueous phase to separate the formic acid and water from the oxidized sulfur compounds as an overhead stream;

distilling the overhead stream to remove water from the formic acid; and recycling the formic acid for reuse in the oxidizing solution.

* * * * *

UNITED STATES PATENT AND TRADEMARK OFFICE

CERTIFICATE OF CORRECTION

PATENT NO. : 6,402,940 B1
DATED : June 11, 2002
INVENTOR(S) : Alkis S. Rappas

It is certified that error appears in the above-identified patent and that said Letters Patent is hereby corrected as shown below:

Title page,
Item [75], INVENTOR(S) should be the following names:
-- Alkis S. Rappas, Kingwood, TX (US)
Vincent P. Nero, Katy, TX (US)
Stephen J. DeCanio, Katy TX (US) --

Signed and Sealed this

Eighth Day of October, 2002

*Attest:*

*Attesting Officer*

JAMES E. ROGAN
*Director of the United States Patent and Trademark Office*